US006712683B2

(12) United States Patent
Brandstetter

(10) Patent No.: US 6,712,683 B2
(45) Date of Patent: Mar. 30, 2004

(54) BACKING PLATE FOR ABRASIVE FLAP WHEELS

(75) Inventor: Josef Brandstetter, Rottenburg a.d. Laaber (DE)

(73) Assignee: Jobra Metall GmbH, Rottenburg/Laaber (DE)

( * ) Notice: Subject to any disclaimer, the term of this patent is extended or adjusted under 35 U.S.C. 154(b) by 36 days.

(21) Appl. No.: 10/002,736

(22) Filed: Nov. 2, 2001

(65) Prior Publication Data

US 2002/0146974 A1 Oct. 10, 2002

(30) Foreign Application Priority Data

Apr. 9, 2001 (DE) ..... 201 06 228 U

(51) Int. Cl.[7] ..... B23F 21/03

(52) U.S. Cl. ..... 451/550; 451/177; 451/259; 451/540; 451/548

(58) Field of Search ..... 451/177, 259, 451/540, 548, 550

(56) References Cited

U.S. PATENT DOCUMENTS

| | | | | | |
|---|---|---|---|---|---|
| 4,541,205 | A | * | 9/1985 | Patrello | 451/342 |
| 4,694,615 | A | * | 9/1987 | MacKay, Jr. | 451/342 |
| 5,951,389 | A | * | 9/1999 | Hettes et al. | |
| 6,044,512 | A | * | 4/2000 | Hornby et al. | 15/97.1 |
| 6,138,317 | A | * | 10/2000 | Holmes et al. | 15/180 |

FOREIGN PATENT DOCUMENTS

| | | |
|---|---|---|
| EP | 0 566 761 | 10/1993 |
| JP | 2000210875 | 8/2000 |
| WO | WO 98/03308 | 1/1998 |

* cited by examiner

*Primary Examiner*—Joseph J. Hail, III
*Assistant Examiner*—Shantese McDonald
(74) *Attorney, Agent, or Firm*—Cohen, Pontani, Lieberman & Pavane

(57) ABSTRACT

A backing plate for an abrasive flap wheel has a sunk inner part and an outer flange. The sunk inner part has a hub which is provided with a location hole having an internal thread. The internal thread serves to fasten the backing wheel to the threaded shaft of a driving machine.

8 Claims, 1 Drawing Sheet

BACKING PLATE FOR ABRASIVE FLAP WHEELS

BACKGROUND OF THE INVENTION

1. Field of the Invention

The invention relates to a backing plate for abrasive flap wheels, having an inner part with a location hole for a shaft of a driving machine and an outer flange for abrasive flaps to be adhesively bonded in place.

2. Description of the Related Art

For a long time there have been backing plates for abrasive flap wheels which are made of a fiber material impregnated with plastic and in which sheet-metal reinforcement is provided around the location hole. These relatively thin backing plates are put onto the shaft, provided with a thread, of a driving machine and screwed tight with a nut. The same type of fastening also exists in abrasive flap wheels in which the backing plates are made of injection molded plastic. In this case, too, only a location hole is provided in the inner part, so that fastening to the machine by means of a nut is necessary.

Such a type of fastening is time-consuming, since, when a wheel is changed, the nut has to be slackened and unscrewed, the new wheel has to be put on and the nut has to be screwed on again. In addition, there is the risk of the nut falling down or of even being lost, which considerably further increases the time needed.

SUMMARY OF THE INVENTION

The object of the invention is to design a backing plate for abrasive flap wheels of the type specified further above in such a way that a quick and nonetheless reliable means of fastening the abrasive flap wheels to the driving machine is possible.

According to the invention, this object is achieved by forming the inner part with a hub which has an internal thread for the threaded shaft of the driving machine.

On account of this design, it is possible to screw the abrasive flap wheel in a simple manner onto the shaft, provided with a thread, of the driving machine without locking having to be carried out with an additional nut. The intended direction of rotation of the driving machine runs in such a way as to tighten the abrasive flap wheel upon coming into working engagement with a workpiece. On the other hand, on account of the relatively large diameter of the abrasive flap wheel, it is possible to slacken said abrasive flap wheel by hand without requiring a tool, which was necessary during the fastening by means of the nut.

In an advantageous development of the invention, provision is made for the hub to be designed so as to project beyond the sunk surface of the backing plate and to have a length which essentially corresponds to the distance between the surface of the outer flange and the surface of the sunk inner part.

In order to achieve a reliable fastening, it is advantageous if the internal thread extends over the entire length of the hub. In this case, it is advantageous if the internal thread has at least three thread turns.

DETAILED DESCRIPTION OF THE PRESENTLY PREFERRED EMBODIMENTS

Figure 1:
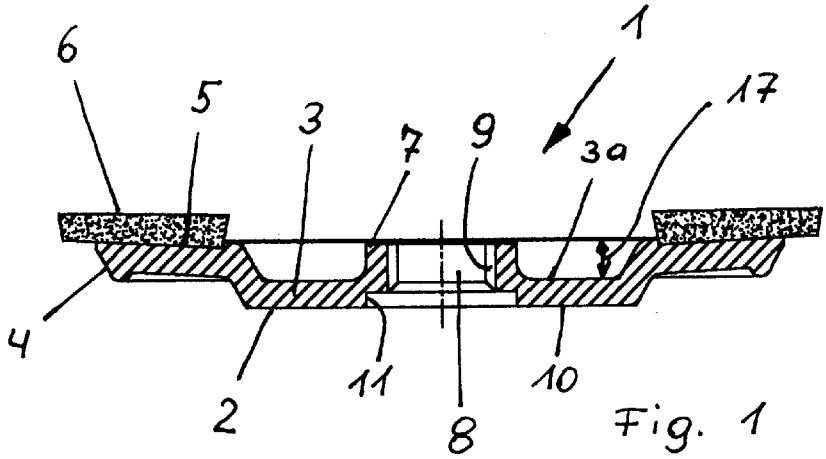
FIG. 1 shows a section through an abrasive flap wheel according to the invention.

The abrasive flap wheel 1 shown in section in the drawing has a backing plate 2 which comprises a sunk inner part 3 and an outer flange 4. Abrasive flaps 6 are in each case arranged in a partly overlapping form on the front side 5 of the outer flange, as is typical of abrasive flap wheels of this type. The abrasive flaps 6 are fastened by adhesive bonding. The sunk inner part 3 has a hub 7 which projects toward the front side 3*a*, i.e. toward the side of the abrasive flaps, and is provided with a location hole 8 and an internal thread 9. A step-like recess 11 is provided on the rear side 10 of the inner part 3.

Figure 2:
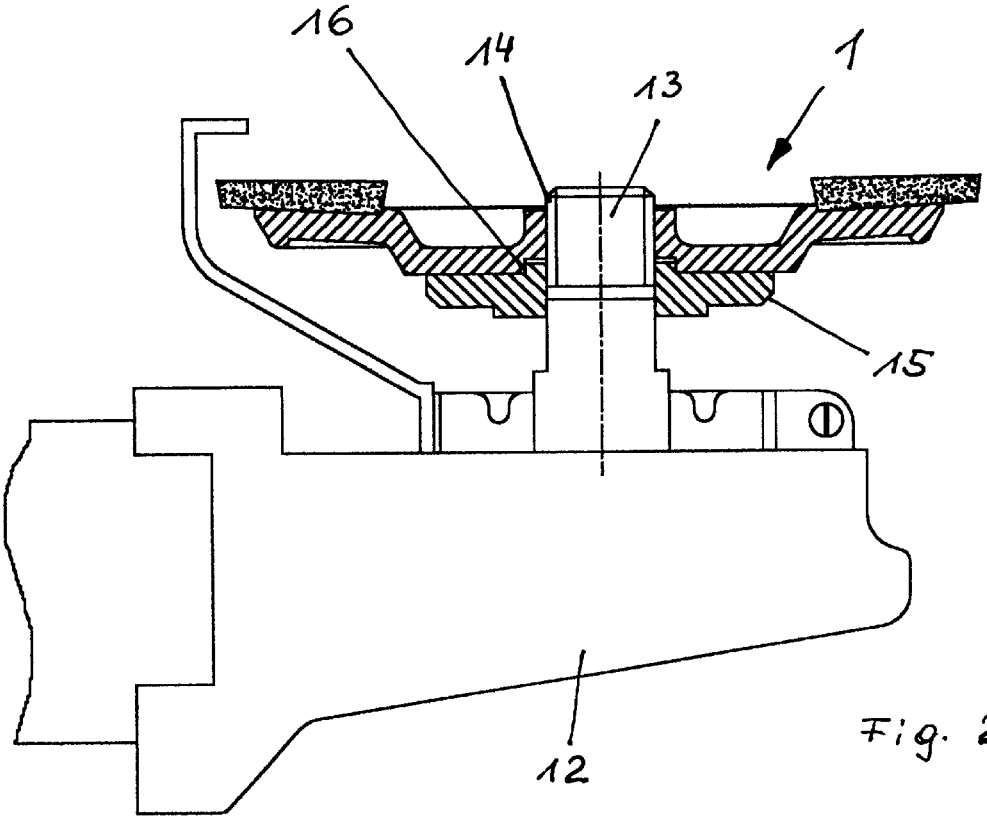
FIG. 2 shows an abrasive flap wheel in section in combination with a driving machine.

As can be seen from FIG. 2, a driving machine 12 has a shaft 13 with an external thread 14. Furthermore, a driver plate 15, which is provided in driving machines of this type for the various abrasive wheels, is put onto the shaft 13. In accordance with FIG. 2, the abrasive flap wheel 1 is screwed onto the shaft 13, the internal thread 9 of the hub 7 of the abrasive flap wheel 1 interacting with the external thread 14 of the shaft 13. In the process, the rear side 10 of the inner part 3 comes to bear on the driver plate 15, a step 16 of this driver plate engaging in the recess 11 of the backing plate 2 in order to ensure reliable centering of the abrasive flap wheel 1 on the shaft 13 of the driving machine 12. The hub 7 has a length projecting beyond the surface 3*a* of the inner part 3, this length corresponding to the distance 17 between the surface 3*a* of the inner part 3 and the front side 5 of the outer flange 4. Thus the hub 7, in combination with the wall thickness of the inner part 3 of the backing plate 2, is long enough and is provided with sufficient thread turns in order to be firmly screwed onto the shaft 13 of the driving machine 12.

What is claimed is:

1. A backing plate for abrasive flap wheels, said backing plate comprising an inner part formed with a hub having a location hole provided with an internal thread for engaging a threaded shaft of a driving machine, and an outer flange having a surface for adhesively bonding abrasive flaps onto said backing plate, said outer flange being formed integrally with said hub, wherein said inner part comprises a sunken surface between said hub and said outer flange, said sunken surface lying a distance below said surface of said outer flange, said hub extending above said sunken surface essentially only by said distance.

2. A backing plate as in claim 1 wherein said location hole has a length, said internal thread extending over the entire length and above said sunken surface by said distance.

3. A backing plate as in claim 1 wherein said internal thread comprises at least two turns.

4. A backing plate as in claim 1 wherein said backing plate is made of injection molded plastic.

5. An abrasive flap wheel comprising:

a backing plate comprising an inner part formed with a hub having a location hole provided with an internal thread for engaging a threaded shaft of a driving machine, an outer flange having a front side for bonding adhesive flaps to said backing plate, said outer flange being formed integrally with said inner part, and a rear side formed with an annular recess surrounding said location hole, and a driver plate having an annular step profiled to fit in said annular recess in order to ensure reliable centering of said abrasive flap wheel on said shaft.

6. An abrasive flap wheel as in claim 5 further comprising abrasive flaps bonded to said front side of said outer flange.

7. An abrasive flap wheel as in claim 5 wherein said inner part comprises a sunken surface between said hub and said outer flange, said sunken surface lying a distance below said surface of said outer flange, said hub extending above said sunken surface essentially by said distance.

8. An abrasive flap wheel as in claim 5 wherein said location hole has a length, said internal thread extending over said entire length.

* * * * *

US006712683C1

(12) EX PARTE REEXAMINATION CERTIFICATE (8533rd)

United States Patent

Brandstetter

(10) Number: US 6,712,683 C1

(45) Certificate Issued: Sep. 13, 2011

(54) BACKING PLATE FOR ABRASIVE FLAP WHEELS

(75) Inventor: Josef Brandstetter, Rottenburg a.d. Laaber (DE)

(73) Assignee: Jobra Metall, GmbH, Rottenburg/Laaber (DE)

Reexamination Request:
No. 90/011,421, Jan. 7, 2011

Reexamination Certificate for:

| | |
|---|---|
| Patent No.: | **6,712,683** |
| Issued: | **Mar. 30, 2004** |
| Appl. No.: | **10/002,736** |
| Filed: | **Nov. 2, 2001** |

(30) Foreign Application Priority Data

Apr. 9, 2001 (DE) ..... 201 060228

(51) Int. Cl.
*B23F 21/03* (2006.01)

(52) U.S. Cl. ..... 451/550; 451/177; 451/259; 451/540; 451/548

(58) Field of Classification Search ..... None
See application file for complete search history.

(56) References Cited

U.S. PATENT DOCUMENTS 5,316,812 A * 5/1994 Stout et al. ..... 428/64.1
6,048,261 A 4/2000 Broido

FOREIGN PATENT DOCUMENTS

| | | |
|---|---|---|
| DE | 30 12 836 C2 | 10/1981 |
| DE | 43 05 317 A1 | 9/1994 |
| EP | 0 542 693 A1 | 5/1993 |

* cited by examiner

*Primary Examiner*—Jeffrey L. Gellner

(57) ABSTRACT

A backing plate for an abrasive flap wheel has a sunk inner part and an outer flange. The sunk inner part has a hub which is provided with a location hole having an internal thread. The internal thread serves to fasten the backing wheel to the threaded shaft of a driving machine.

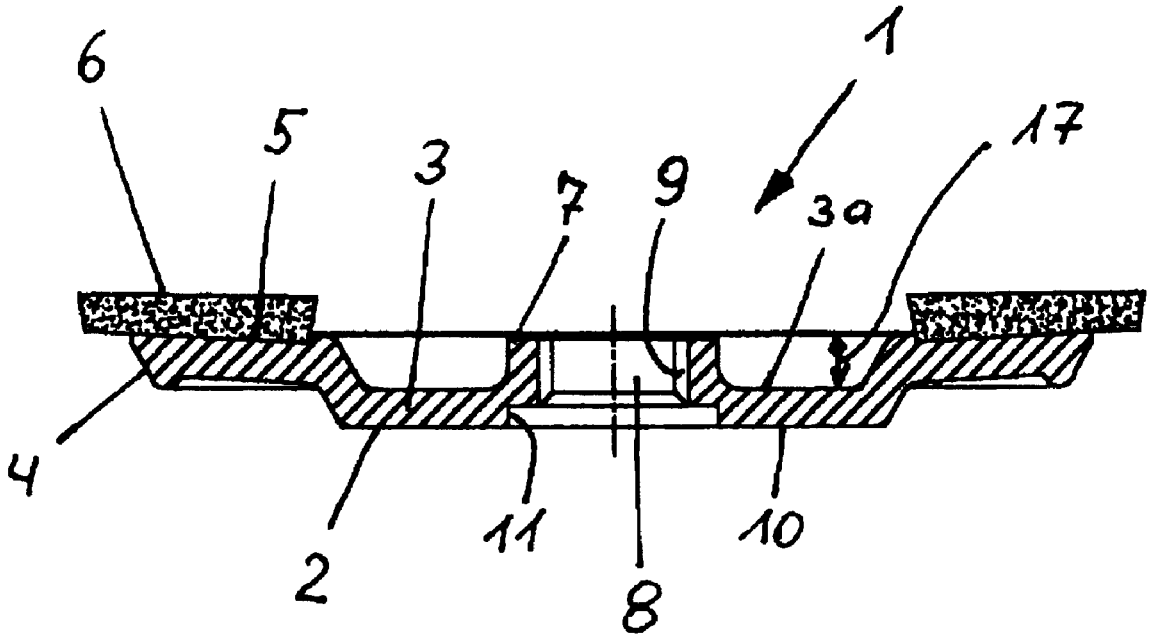

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 5-8 is confirmed.

Claims 1-4 are cancelled.

* * * * *

US006712683C2

(12) EX PARTE REEXAMINATION CERTIFICATE (10635th)

United States Patent
Brandstetter

(10) Number: US 6,712,683 C2
(45) Certificate Issued: Jun. 19, 2015

(54) BACKING PLATE FOR ABRASIVE FLAP WHEELS

(75) Inventor: Josef Brandstetter, Rottenburg a.d. Laaber (DE)

(73) Assignee: JOBRA METALL GMBH, Rottenburg/Laaber (DE)

Reexamination Request:
No. 90/013,362, Oct. 6, 2014

Reexamination Certificate for:

| | |
|---|---|
| Patent No.: | **6,712,683** |
| Issued: | **Mar. 30, 2004** |
| Appl. No.: | **10/002,736** |
| Filed: | **Nov. 2, 2001** |

Reexamination Certificate C1 6,712,683 issued Sep. 13, 2011

(30) Foreign Application Priority Data

Apr. 9, 2001 (DE) ..... 201 06 228

(51) Int. Cl.

| | |
|---|---|
| ***B23F 21/03*** | (2006.01) |
| ***B24B 45/00*** | (2006.01) |
| ***B24D 9/08*** | (2006.01) |

(52) U.S. Cl.
CPC .. *B24B 45/00* (2013.01); *B24D 9/08* (2013.01)

(58) Field of Classification Search
CPC ..... B60B 45/00; B24D 9/08
See application file for complete search history.

(56) References Cited

To view the complete listing of prior art documents cited during the proceeding for Reexamination Control Number 90/013,362, please refer to the USPTO's public Patent Application Information Retrieval (PAIR) system under the Display References tab.

*Primary Examiner* — Russell Stormer

(57) ABSTRACT

A backing plate for an abrasive flap wheel has a sunk inner part and an outer flange. The sunk inner part has a hub which is provided with a location hole having an internal thread. The internal thread serves to fasten the backing wheel to the threaded shaft of a driving machine.

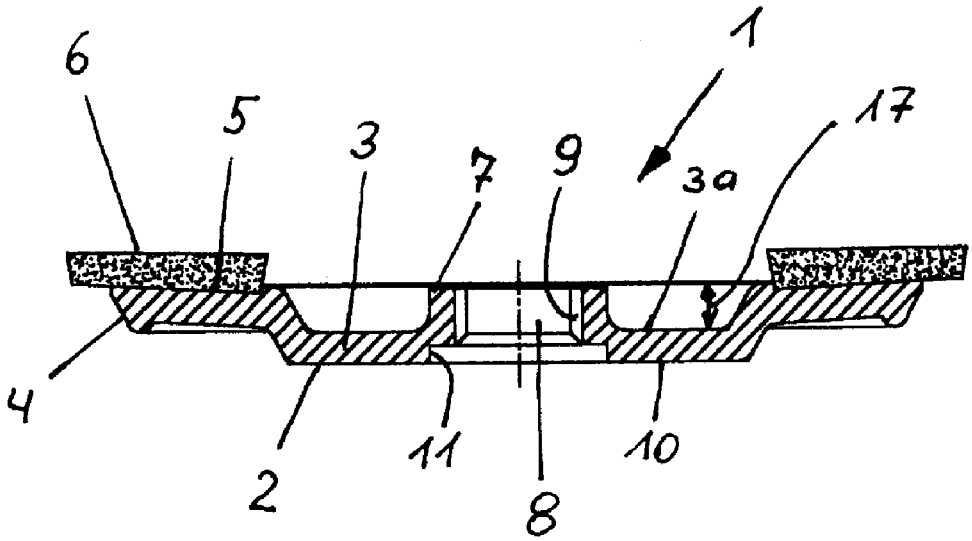

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-4 were previously cancelled.

Claims 5-8 are cancelled.

* * * * *